US005154508A

United States Patent [19]

Ahroni

[11] Patent Number: 5,154,508

[45] Date of Patent: Oct. 13, 1992

[54] LOCKING SYSTEM FOR LIGHT ASSEMBLY WITH PUSH-IN BULB UNIT

[76] Inventor: Joseph M. Ahroni, 2701 W. Manor Place #204, Seattle, Wash. 98199

[21] Appl. No.: 725,586

[22] Filed: Jul. 3, 1991

Related U.S. Application Data

[63] Continuation-in-part of Ser. No. 637,477, Jan. 4, 1991, Pat. No. 5,121,310, which is a continuation-in-part of Ser. No. 461,489, Jan. 5, 1990, abandoned.

[51] Int. Cl.[5] ..... H01R 33/00

[52] U.S. Cl. ..... 362/226; 362/396; 313/51; 439/360

[58] Field of Search ..... 362/226, 239, 250, 391, 362/393, 396, 806; 313/51; 439/360

[56] References Cited

U.S. PATENT DOCUMENTS

| | | | |
|---|---|---|---|
| 4,100,448 | 7/1978 | Chipner et al. | 313/51 X |
| 4,679,126 | 7/1987 | Van Sickler | 362/226 |
| 4,943,899 | 7/1990 | Tseng | 362/226 |
| 4,970,632 | 11/1990 | Tseng | 362/226 |
| 4,999,751 | 3/1991 | Chen | 362/226 |

*Primary Examiner*—Stephen F. Husar
*Attorney, Agent, or Firm*—Seed and Berry

[57] ABSTRACT

A light unit of the type with a push-in bulb assembly has complementing locking elements on the bulb assembly and lamp holder into which the bulb assembly is mounted. Examples include a hook-like element which springs over a passive element, a prong and complementing opening, and a hinged T-shaped element which swings into locking position between and beneath a pair of ear elements.

8 Claims, 3 Drawing Sheets

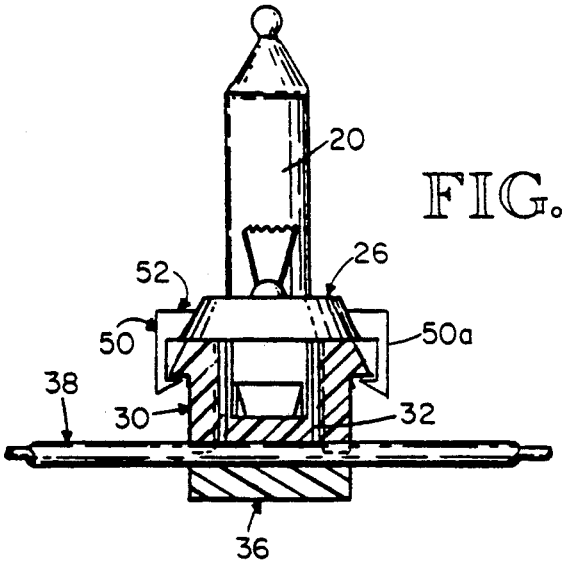
FIG. 3
FIG. 4
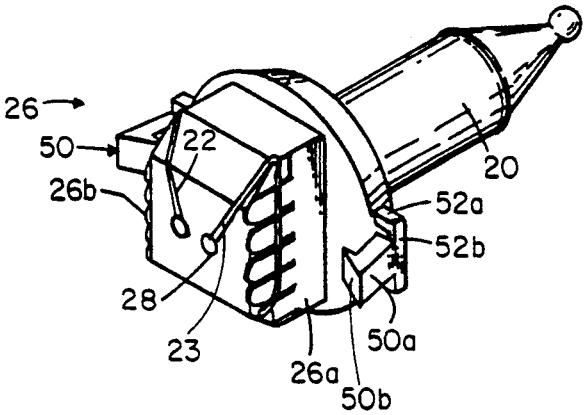
FIG. 5
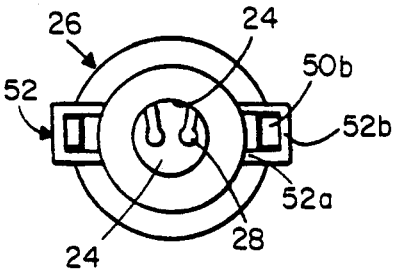
FIG. 6
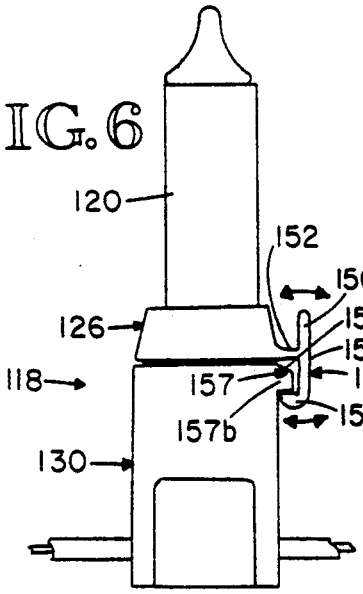
FIG. 7
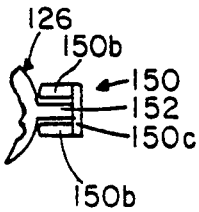

FIG. 8
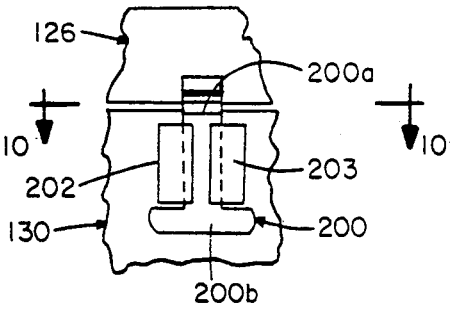
FIG. 9
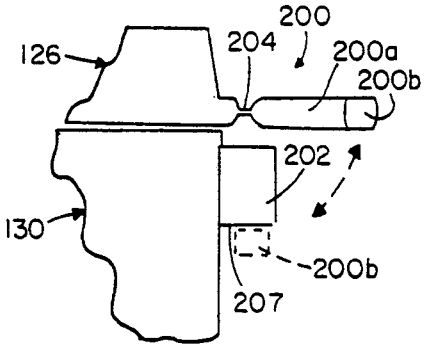
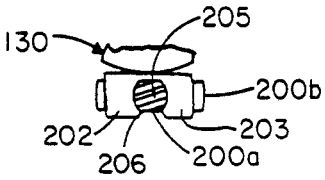
FIG. 10
FIG. 11
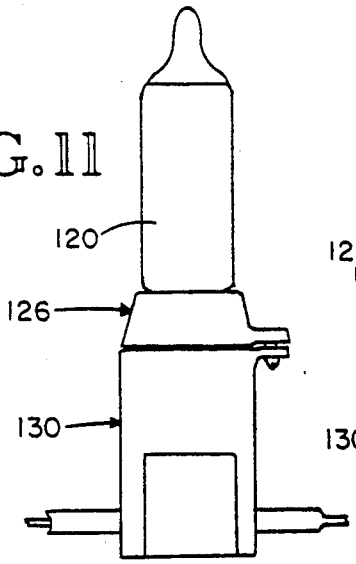
FIG. 12
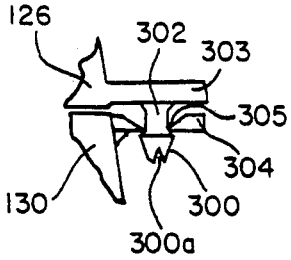

LOCKING SYSTEM FOR LIGHT ASSEMBLY WITH PUSH-IN BULB UNIT

REFERENCE TO RELATED APPLICATIONS

This application is a continuation-in-part of my copending application Ser. No. 07/637,477, filed Jan. 4, 1991, which is a continuation-in-part of my abandoned application, Ser. No. 07/461,489, filed Jan. 5, 1990 abandoned.

TECHNICAL FIELD

The present invention relates to light units with push-in type of bulb assemblies as commonly used in decorative light sets such, for example, as 2-wire series sets, 3-wire series-parallel sets, and 5-wire chaser sets. An example of such a 3-wire set is shown in U.S. Pat. No. 4,779,177, and my copending application Ser. No. 07/637,477, now U.S. Pat. No. 5,121,310, shows an example of such a chaser set.

BACKGROUND OF THE INVENTION

In a typical push-in bulb assembly a bulb is mounted in a plastic lamp base and has a pair of lead wires which extend through the bottom of the lamp base and double back over opposite outer side faces of a plug-in portion of the lamp base. The lamp base plugs into a socket in a lampholder presenting contact elements at opposite sides which are engaged by the lead wires from the bulb. The contact elements in turn engage insulated wires which may be presented by a single cord as shown in the above-referenced patent and patent application. Preferably the plug-in portion of the lamp base and the socket in the lampholder are shaped so that the lamp base must be properly oriented for proper lead wire to contact element engagement in order for the plug-in portion to be pushed into the socket.

Sometimes the plug-in portion of the lamp base in a plug-in light assembly works loose from the lampholder socket sufficiently to break electrical contact between the bulb leads and the contact elements in the lampholder. This can occur, for example, during packing and shipping, or while the set is being handled while being mounted in a decorating position or removed therefrom for storage.

Although a relatively snug fit between the lamp base and the lampholder is preferred to maintain electrical contact between the bulb leads and the contact elements, it is also preferred to have the bulb holders relatively easy to remove for bulb replacement in case of bulb failure. Accordingly, there is a need for a practical, effective lock-on system to prevent unintentional dislodgement of the lamp bases in the lampholders of plug-in type decorative light units, but which can be easily manually released for bulb replacement. Since the lamp bases and lampholders are normally plastic injection-molded parts, a solution to the lamp loosening problem is not practical if it unduly complicates the molding process or assembly of the sets.

SUMMARY OF THE INVENTION

The present invention meets the lock-on need by providing cooperating locking elements on the lamp base and lampholder components unit which are injection molded as integral parts of these components. In one embodiment of the invention, one of the locking elements is hook-like and depends from a U-shaped mounting piece to snap over a protrusion providing a complementing retaining shoulder when the lamp base is pushed into the lampholder. The U-shape of the mounting piece permits a male element in the injection molding die for forming the bill of the hook-like element to occupy a position passing through the mounting pieces. In another embodiment, the hook-like element has two bills which are laterally offset with respect to a mounting element.

In still another embodiment, a T-shaped locking element having a swing leg and crosshead is molded at right angles to its locking position for ease of molding. The stem is necked at its root end to form a hinge so that the locking element can be swung into locking position whereat the crosshead is positioned beneath a pair of spaced ears and the leg snap fits between the ears.

BRIEF DESCRIPTION OF THE DRAWINGS

FIG. 3 is a vertical sectional view taken as indicated by lines 3—3 in FIG. 2;

FIG. 4 is a bottom perspective view of a lamp base unit with bulb installed of the type shown in FIG. 1;

FIG. 5 is a top plan view of the lamp base unit of FIG. 4 without the bulb;

FIG. 6 is a side elevational view of a lamp unit provided with an alternative locking assembly embodiment;

FIG. 7 is a fragmentary top plan view showing the locking assembly of FIG. 7;

FIG. 8 is a fragmentary front elevational view showing another alternative locking assembly embodiment;

FIG. 9 is a fragmentary side elevational view showing the FIG. 8 embodiment with the active locking element shown in unlocked position; and FIG. 10 is a sectional view taken as indicated by line 10—10 in FIG. 8.

FIG. 11 is a side elevational view of a lampholder provided with still another locking embodiment; and FIG. 12 is an enlarged detail elevational view with the lower locking element of the FIG. 11 embodiment in vertical section.

DETAILED DESCRIPTION OF THE INVENTION

Figures 1, 2:
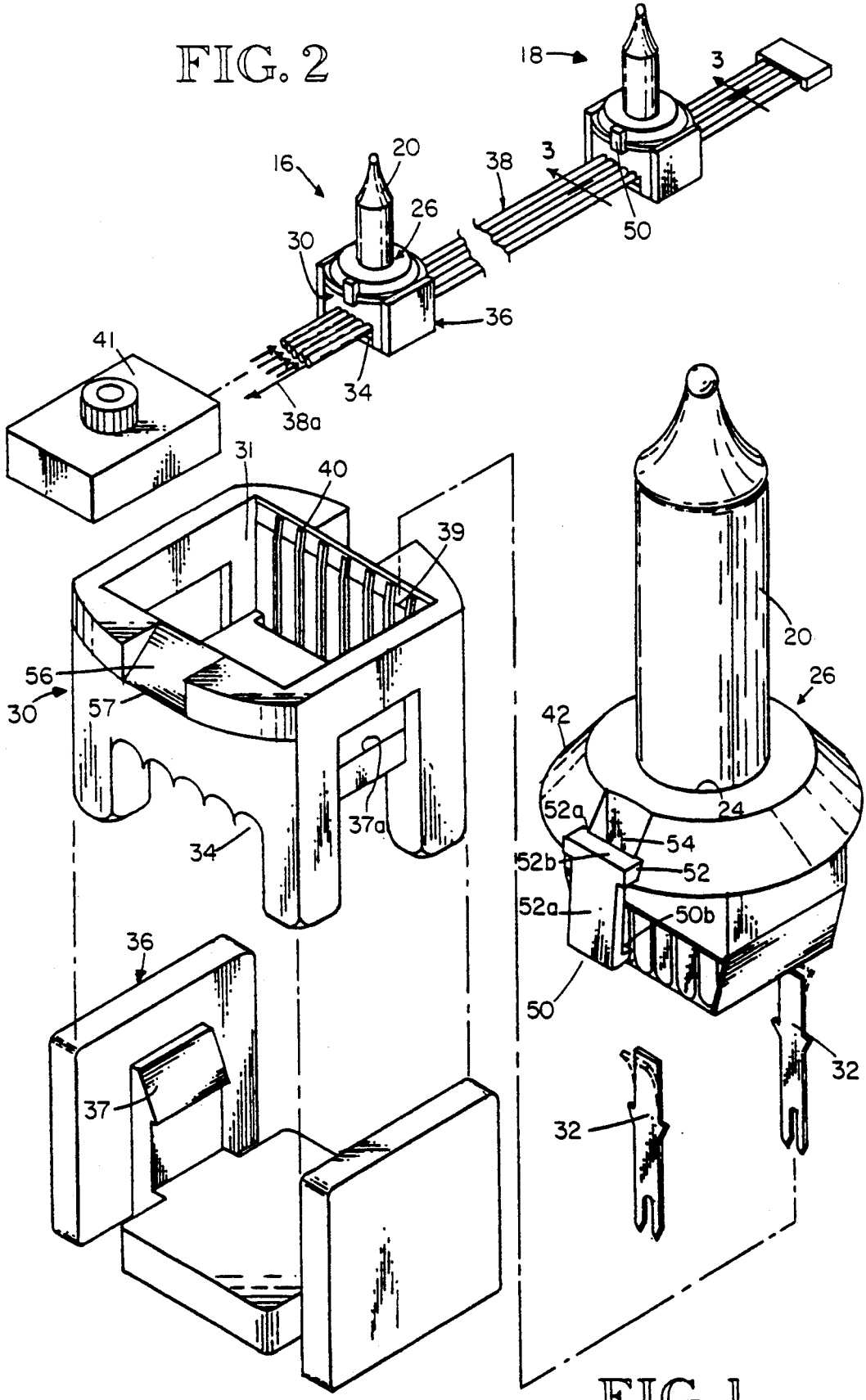
FIG. 1 is an exploded view of a light assembly for a chaser set, for example, embodying the present invention.
FIG. 2 is a fragmentary perspective view of a chaser light set with light assemblies of the type shown in FIG. 1.

For purposes of example, the invention is illustrated as applied to a 5-wire chaser set 16 of the type shown in my copending application Ser. No. 07/637,477. Each lamp assembly 18 in the set has a bulb 20 with a pair of lead wires 22, 23. The bulb 20 fits into a socket 24 provided by a lamp base 26 which has a pair of bottom openings 28 through which the leads 22, 23 are fed. The leads extend from the openings 28, 29 to fixed positions across opposite side faces **26*a*, 26*b* of the lamp base 26**.

The lamp base 26 is complemented by a lampholder housing 30 providing a socket 31 to receive the base portion of the lamp base. A pair of contact elements 32 are mounted in selected positions at opposite sides of the socket 31 to be engaged by the portions of the leads 22, 23. The contact elements 32 project by insulating-piercing ends into a wireway 34 formed by the housing 30 and a base unit 36 which snap fits by snap elements 37 with the housing 30 at **37*a*. In the case of the chaser set the wireway 34 is shaped to receive five insulated wires, preferably provided by a single cord 38. The two contact elements 32 are positioned in selected channels 39 provided by ribs 40 and pierce the cord insulation to engage the appropriate wire. This wire is interrupted between the contact elements 32 so that a circuit through the interrupted wire is completed via the contact elements 32, lead wires 22, 23 and the filaments in bulb 20. The contact elements in every fourth lampholder occupy the same channels 39 so that every fourth bulb in the set lights at the same time when the respective wire is energized by action of a controller 41 which selectively completes a circuit via a return wire 38***a* in the cord.

As part of the present invention the rim portion 42 of the lamp base 26 is provided with one or more hook-like active locking elements 50 each having a stem 50*a* carrying a turned-in locking bill 50*b*. The stem 50*a* is connected to the rim 40 by a U-shaped mounting piece 52 having a pair of support arms 52*a* and an intermediate mounting piece 52*b*. The gap 54 between the support arms 52*a* is aligned with the locking bill 50*b* so as to provide a withdrawal path for a male element in the injection molding die which forms the upper face 52*c* of the locking bill 52. The stem 50*a* has sufficient resiliency to act as a spring finger so that the locking bill 52*b* can spring outwardly sufficiently to ride over a ramp 56 provided at the top of the lampholder 30 and snap back beneath a shoulder 57 adjoining the ramp 56 to function as a passive locking element or keeper when the lamp base is pushed into the socket 31 provided by the lampholder 30 during assembly of the light set.

The locking bill 50*b* can be manually sprung outwardly out of locking position beneath the shoulder 57 when it is desired to remove the lamp base unit 26 for bulb replacement. It is not essential that the locking bill 50*b* fit snugly beneath the shoulder 57. A gap can initially exist between the locking bill 50*b* and shoulder 57 since the purpose of the locking feature is to restrict the amount of withdrawal of the lamp base 26 from the lampholder 30 to an amount maintaining completion of the circuit.

In the case of the illustrated lamp unit for a chaser set it is preferred that a pair of locking elements 50 be provided. However, for a smaller lamp unit as, for example, on 3-wire sets of the type shown in my prior U.S. Pat. No. 4,779,177, a single locking element is preferred. In FIGS. 6–7 a lamp assembly 118 for a 3-wire set is shown with an alternative hook-like locking unit 150 mounted on a single support arm 152 extending from the rim of the lamp base 126 which holds a bulb 120 having lead wires engaging contact elements in the lampholder 130. This cooperates with a passive locking element 157 on the lampholder taking the form of a protuberance with a top sloped ramp 157*a* and a bottom shoulder 157*b*. The locking element 150 cooperates with a passive locking element 157 on the lampholder taking the form of a protuberance with a top sloped ramp 157*a* and a bottom shoulder 157*b*. A pair of in-turned locking bills 150*b* are provided at the lower end of the leg 150*b* and are spaced apart in accordance with the width of the support arm 152 so that male die elements defining the upper side of the bills 150*a* can be withdrawn beside the support arm 152*a* during injection molding of the lamp base. During pushing of the lamp base 126 into the lampholder 130, the leg 150*b* flexes outwardly sufficiently for the bills 150*a* to ride over the element 157 into locking position beneath bottom shoulder 150*b*.

An upward extension 150*c* of the locking unit 150 can be provided above the connection of the leg 150*b* to the support arm 152. This extension 150*c* can be pressed inwardly toward the lamp base 126 thereby springing the bills 150*a* outwardly to assist in releasing them from beneath the shoulder 157*b* when it is desired to remove the lamp base 126 to replace the bulb 120.

Another alternative is shown in FIGS. 8–10, also applied to the lamp socket assembly for a 3-wire set, for example. In this embodiment a generally T-shaped active locking unit 200 has a swing leg 200*a* extending laterally from the rim of the lamp base 126 and has a crosshead 200*b* at its outer end. The root end portion of the support arm 200*a* is preferably necked to provide an integral hinge 204. The socket housing 130 presents a complementing locking element in the form of a pair of ears 202, 203 arranged to receive the swing leg 200*a* there between with a snap fit and with the crosshead 200*b* positioned beneath the ears. The ears preferably have opposed concave opposed jaw faces 205 providing a restricted entry opening therebetween through which the swing leg 200*a* can pass by yielding of the entry portions 206 of the ears 202, 203. The bottom faces 207 of the ears function as stops engaged the crosshead 200*b* in the event the lamp base 126 tends to separate from the lampholder 130. The swing leg 200*a* and crosshead 200*b* are molded in their laterally extending, inactive position (FIG. 9) with the lamp base 126 as a unit.

Still another embodiment is shown in FIG. 11–12 also applied to the lamp socket assembly for a 3-wire set, for example. In this embodiment a tapered locking prong 300 is mounted at the lower end of a stem 302 which depends from a flange 303. This flange 303 projects integrally from the rim of the lamp base 126 and overlies a flange 304 projecting integrally from the lampholder 130.

A tapered opening 305 is provided in the lower flange 304 to cooperate with the locking prong 300. The rim of the opening 305 is flexible enough to expand upon entry of the head of the prong 300 so that the prong can be forced through the opening when the lamp base 126 is pushed into the lampholder. The prong 300 may be split as indicated at 300*a* to assist in passing through the opening 305. If the bulb 120 needs to be replaced, the prong 300 can be forced back through the opening 305 to release the lamp base 126.

The various embodiments have been illustrated with an active locking element mounted on the lamp base and a relatively passive locking element mounted on the lampholder. It will be appreciated that these mounting locations can be reversed.

The first two embodiments (FIGS. 1–5 and 6–7) with the hook-like active locking elements, and the fourth embodiment with the prong element, have the advantage that these elements automatically assume a locking position responsive to pushing the lamp base (with bulb installed) into the lampholder socket. The third embodiment (FIGS. 8–10) requires that the T-shaped locking element be swung into locking position after the lamp base has been pushed into the lamp holder socket. All four embodiments permit the locking elements to be injection molded with the lamp base and lampholder without unduly complicating the dies.

From the foregoing, it will be appreciated that, although specific embodiments of the invention have been described herein for purposes of illustration, various modifications may be made in the locking elements without deviating from the spirit and scope of the invention. Accordingly, the invention is not limited except as by the appended claims.

I claim:

1. A light assembly comprising:

a plastic lamp socket unit presenting a socket;

a plastic plug-in lamp base unit in said socket and having a bulb mounted therein;

a first locking element integral with a first of said units;

a complementing second locking element integral with the second of said units;

said first locking element being in locking relationship with the second locking element to lock said units together, and being adapted to be moved out of said locking relationship when it is desired to remove said lamp base unit from said socket;

said second locking element presenting a shoulder, and said first locking element being hook-like and presenting a locking bill which opposes said shoulder when said locking elements are in locking relationship, said first locking element being flexible to an extent permitting said locking bill to be moved out of said locking relationship when it is desired to remove said lamp base unit from said socket; and said first unit having a pair of spaced-apart support arms connected by a central bridge which is connected to said first locking element, there being a passage defined by said arms, bridge, and first unit, which is aligned with said locking bill.

2. A light assembly according to claim 1 in which said units have a longitudinal axis along which said lamp base unit removes relative to said lamp socket unit when said units are moved relative to one another for insertion or removal of said lamp base unit from said socket, said passage being parallel to said longitudinal axis.

3. A light assembly according to claim 2 in which all of said locking bill is aligned with said passage.

4. A light assembly according to claim 1 in which said first locking element is mounted on said lamp base unit.

5. A light assembly comprising:

a plastic lamp socket unit presenting a socket;

a plastic plug-in lamp base unit in said socket and having a bulb mounted therein;

a first locking element integral with a first said units;

a complementing second locking element integral with the second of said units;

said first locking element being in locking relationship with the second locking element to lock said units together, and being adapted to be moved out of said locking relationship when it is desired to remove said lamp base unit from said socket;

said second locking element presenting a shoulder, and said first locking element being hook-like and presenting a locking bill which opposes said shoulder when said locking elements are in locking relationship, said first locking element being flexible to an extent permitting said locking bill to be moved out of said locking relationship when it is desired to remove said lamp base unit from said socket; and said first unit having an arm which supports said first locking element, said bill being offset from alignment with said arm.

6. A light assembly according to claim 5 in which said first locking element has a pair of spaced apart bills which are offset from alignment with said arm on opposite sides of said arm.

7. A light assembly according to claim 6 in which said first locking element has an extension on the opposite side of said arm from said bills whereby manual deflection of said extension assists in releasing of said locking bills from locking position.

8. A light assembly comprising:

a plastic lamp socket presenting a socket;

a plastic plug-in lamp base unit in said socket and having a bulb mounted therein;

a first locking element integral with a first said units;

a complementing second locking element integral with the second of said units;

said first locking element being in locking relationship with the second locking element to lock said units together, and being adapted to be moved of said locking relationship when it is desired to remove said lamp base unit from said socket;

said second locking element presenting a shoulder, and said first locking element being hook-like and presenting a locking bill which opposes said shoulder when said locking elements are in locking relationship, said first locking element being flexible to an extent permitting said locking bill to be moved out of said locking relationship when it is desired to remove said lamp base unit from said socket; and said first locking element having a support arm connected to said first unit, and having an extension on the opposite side of said arm from said locking bill whereby manual deflection of said extension assists in releasing of said locking bill from locking position.

* * * * *

UNITED STATES PATENT AND TRADEMARK OFFICE

CERTIFICATE OF CORRECTION

PATENT NO. : 5,154,508
DATED : October 13, 1992
INVENTOR(S) : Joseph M. Ahroni

It is certified that error appears in the above-indentified patent and that said Letters Patent is hereby corrected as shown below:

In column 5, claim 2, line 32, please delete "removes" and substitute therefor --moves--.

In column 6, claim 7, line 32, please insert --out-- between "moved" and "of".

Signed and Sealed this

Nineteenth Day of October, 1993

*Attest:*

*Attesting Officer*

BRUCE LEHMAN

*Commissioner of Patents and Trademarks*